United States Patent [19]

Steiling

[11] 4,054,070

[45] Oct. 18, 1977

[54] PANEL SAW MECHANISM

[75] Inventor: Virgil Steiling, Tacoma, Wash.

[73] Assignee: Globe Machine Manufacturing Company, Tacoma, Wash.

[21] Appl. No.: 686,701

[22] Filed: May 17, 1976

[51] Int. Cl.[2] ..... B27B 5/06

[52] U.S. Cl. ..... 83/208; 83/47; 83/369; 83/436; 83/408; 83/425.3; 83/437

[58] Field of Search ..... 83/49, 208, 369, 408, 83/418, 420, 425.3, 436, 437, 47

[56] References Cited

U.S. PATENT DOCUMENTS

| | | | |
|---|---|---|---|
| 3,108,509 | 10/1963 | Felix | 83/369 X |
| 3,236,272 | 2/1966 | Lawson | 83/436 |
| 3,522,825 | 8/1970 | Wehner | 83/47 X |
| 3,523,392 | 8/1970 | Carl | 83/208 X |
| 3,570,561 | 3/1971 | Frodermann et al. | 83/47 X |

*Primary Examiner*—Donald R. Schran

[57] ABSTRACT

A cut-to-size saw mechanism having a dual, programable control system is provided for large sheet material, as plywood, hardboard, chipboard, fiberboard, and other large panels to be divided into small pieces by sawing. Sheet sizes in the range of 5 × 18′ can be cut with a main strip or strips and a side, residual strip, with the residual having a maximum width up to a predetermined amount, such as 2′. Where desired, cutting patterns necessitate two asymmetrical patterns, the saw mechanism can be programmed to trim all 4 edges of a panel, divide the panel into main and residual longitudinal strips and cut the main strip or strips in one pattern length and the residual strip in another selected pattern length. All sawing is done while the panels or strips thereof are held by hold-down rolls, thereby assuring precision sawing. All sawing of the entire panel is programmed by thumb switches from a control panel and the same program may be repeated on subsequent panels until the programming is changed.

7 Claims, 10 Drawing Figures

68
66
64
44
42
40

68
66
64
32
34
36
38
44
42
40

68
66
40
62
64
44
42

PANEL SAW MECHANISM

BACKGROUND OF THE INVENTION

In the prior art of saw cutting large sheets to provide a plurality of pieces of predetermined dimensions, it was common practice to cut in one machine, the said large sheets into a main longitudinal strip or strips of desired widths and leave a longitudinal residual strip of a width determined by the original sheet width less the width of the main strip or strips. Then the strips were often cross cut at one time in a second machine and to a common length determined by the desired length of the pieces obtained from the main longitudinal strip or strips. Thus, regardless of the useful or desired length of the pieces cut from the residual strip, they were often cut to length determined by the length of the pieces cut from the main strip to avoid cutting such strips as a separate operation in a separate machine. This prior art practice often resulted in the loss of stock in the order of about 15% of the original sheet size. Thus, the prior art does not provide for a single machine for the saw cutting of sheet stock into two or more longitudinal strips and then provide for cross cutting the said strips into two asymmetrical patterns.

BRIEF DESCRIPTION OF THE INVENTION

It is an object of this invention to provide a cut-to-size saw mechanism which will permit the saws to be set to provide for trimming of two side edges of a piece of sheet stock and to provide one or more longitudinal main strips and a single residual strip having a predetermined maximum width, such as up to 24 inches. The saw cutting of a piece of sheet stock is obtained while the stock is held in alignment under holddown rolls, thus assuring precision sawing. The crosscut saw mechanism operates while the hold-down rolls maintain the alignment of the main and residual strips and thus, again, there is precision sawing. The crosscut saw mechanism is responsive to two measuring rolls, one of which engages the main strip and the other, the residual strip as they pass such rolls. The measuring roll for the main strip or strips connects with programmable mechanism, so that the main strip or strips can be moved forward a selected amount, stopped, sawed, and then subsequent forward motion, stopping, and sawing until the main strip or strips have had the advancing end portions thereof end trimmed, the strips have been sawed into pieces of desired length, and the trailing end portions have been end trimmed —all such sawing being had, when so selected, while the residual strip has been held without motion. Thereafter, the residual strip can be separately trimmed and cut in a pattern which is asymmetrical to the pattern of cutting of the main strip or strips. The programming mechanism for the residual strip connects with the separate measuring roll therefor and thus, programming need have no similarity to the program of cutting of the main strip or strips.

Other objects of this invention will become explicit or implicit as the description of the invention proceeds in connection with the following detailed description.

DESCRIPTION OF THE DRAWINGS

A more complete understanding of the invention may be had by references to the accompanying drawings illustrating preferred embodiments of the invention in which like reference characters refer to like parts throughout the several views and in which:

FIG. 4 is a fragmentary, perspective view illustrating a panel on the in-feed mechanism and traveling therefrom sideways into the machine;

FIG. 5 is a view illustrating the panel then traveling lengthwise of the machine and being cut into two main strips, one a residual strip and with the side edges of the panel being trimmed;

FIG. 6 is a view showing the residual strip being held back, the main strips having traveled and a cross cut being started across the main strips and being substantially complete thereacross;

FIG. 7 is a view showing the cut pieces of the main strip and a cross cut being stroked through the residual strip.

Figure 1A:
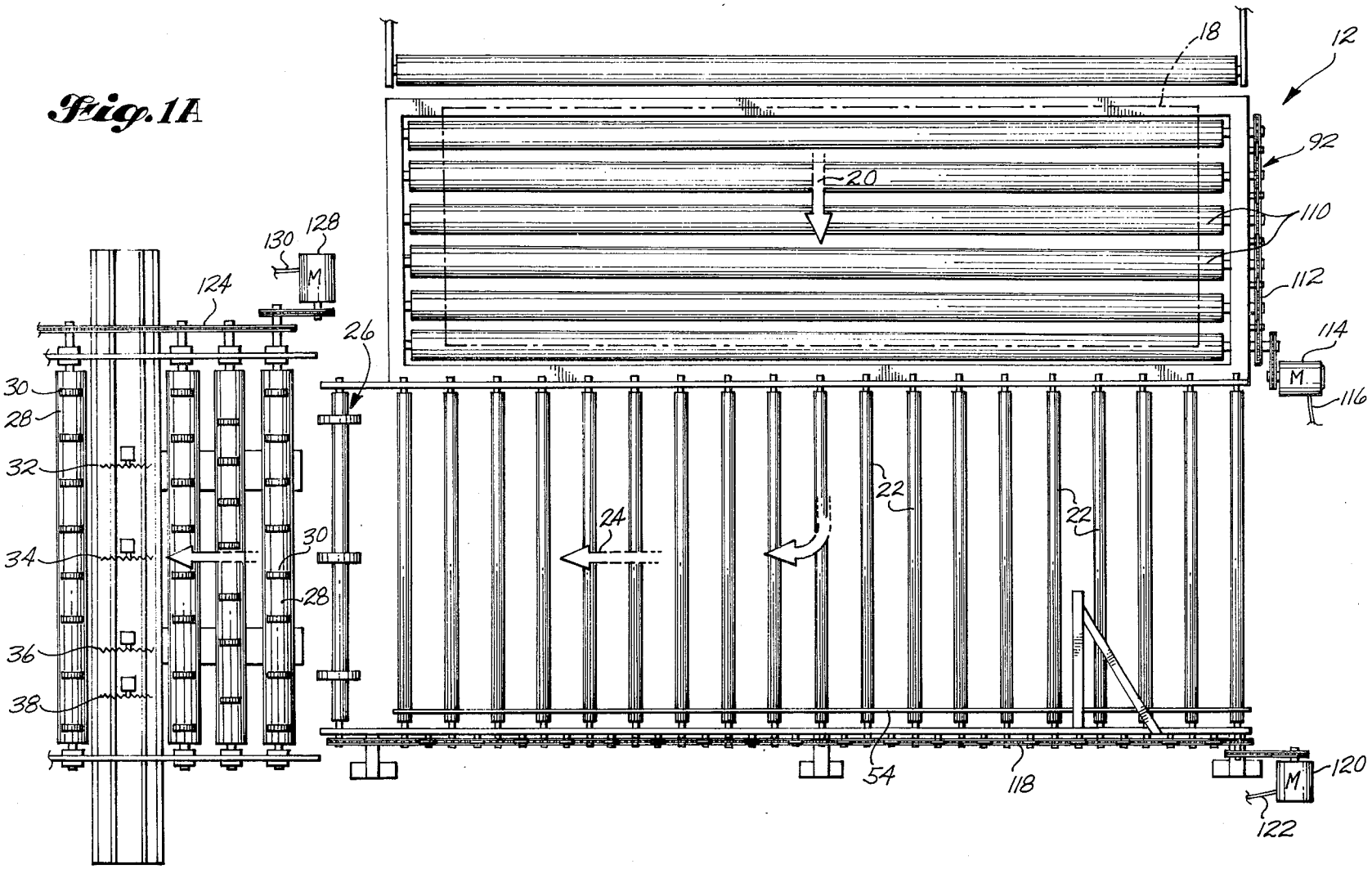
FIG. 1A is a plan view of approximately the right one-half portion of the machine.

The main framework of the machine is generally numbered 10 throughout and which main frame 10 supports an infeed mechanism 12 (FIG. 1A). This infeed mechanism is standard on the market for feeding the top panel crosswise of a stack of panels 16 into machinery for processing the large sheet material or panels of a size in the range of $5 \times 18$inches. With such large surface area panels and with the weight involved (a substantial height of a stack of panels is necessary to provide the necessary reserve), the friction present between panels with one moving and the adjacent contacting panel being stationary is such that feeding from the top of a stack of panels as distinguished from feeding from the bottom of a stack of panels is necessary. An automatic elevator (not shown) supports a stack of panels so that the topmost panel 18 is maintained at the proper level to slide crosswise in the direction of the arrow 20 (FIG. 1A) from the top of a stack of panels disposed on the in-feed mechanism 12 and onto the conveyor rolls 22.

The machine is programmed, as will be later discussed in more detail, to automatically feed the top panel from the in-feed mechanism 12 crosswise and onto the rolls 22 and at the proper time, then to feed a panel on rolls 22 at the proper time in the direction of the arrow 24 (FIG. 1A).

Figure 2A:
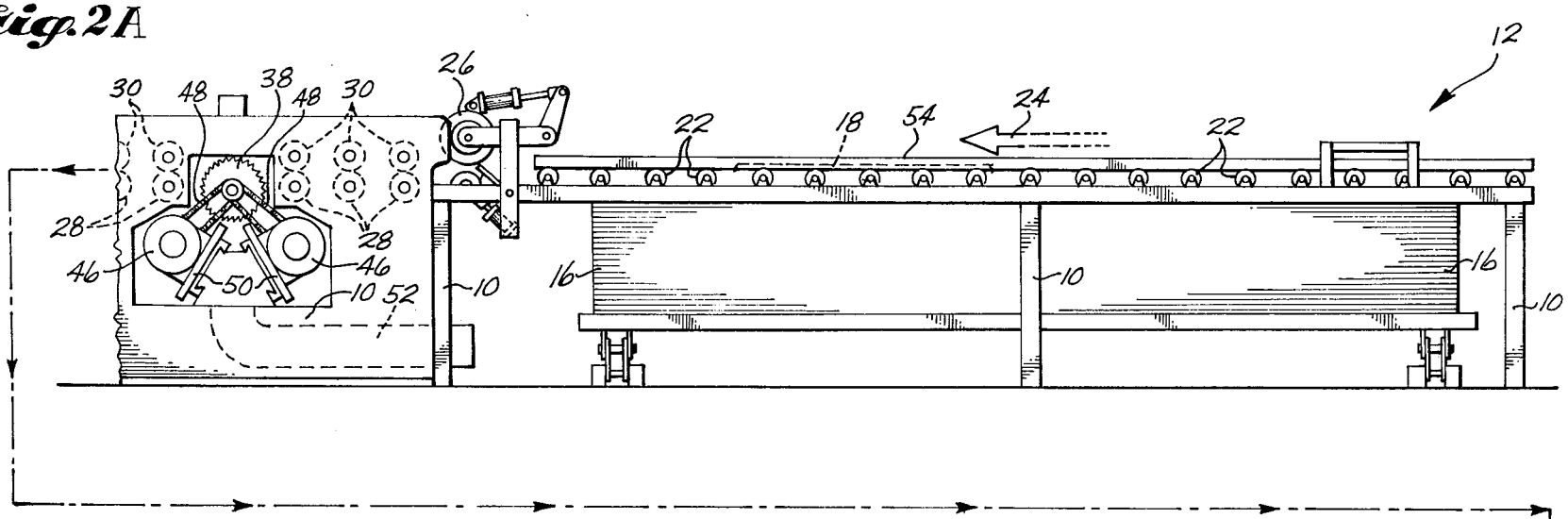
FIG. 2A is an elevational view of substantially the right one-half of the machine.

When appropriate, a panel is fed in the direction of the arrows 24 and the advancing end thereof passes between the rolls of panel control mechanism 26. The panel passes between lower driven rolls 28 and upper hold-down rolls 30 and through a plurality of laterally spaced rip saws, illustrated by saws 32, 34, 36, and 38 (see FIG. 1A). The saws 32 and 38 trim the two side edges of the panel and the saw 36 cuts off the residual strip 40 from the main strip or strips 42, 44 (shown in FIGS. 4 to 7). Each of the saws 32, 34, 36, and 38 and the driving means therefor, is adjustably mounted so that any width stock (within the limits of the machine) can have its edge trimmed by saws 32 and 38, the main panel can be provided in one or more main strips 42, 44 within the limits of the size of the original panel by the saw or saws 34 and 36, and the residual strip 40 will be the remainder of the original panel as cut by the saw 36 and is edge trimmed by the saw 38. Each of the saws 32, 34, 36, 38 may have a separate driving motor, as motor 46 (FIG. 2A) and drive belts 48 and mount 50 supported by the main frame 10 of the machine. Also, sawdust vacuum discharge 52 is provided to remove the sawdust discharging from each of the said saws.

Figure 3:
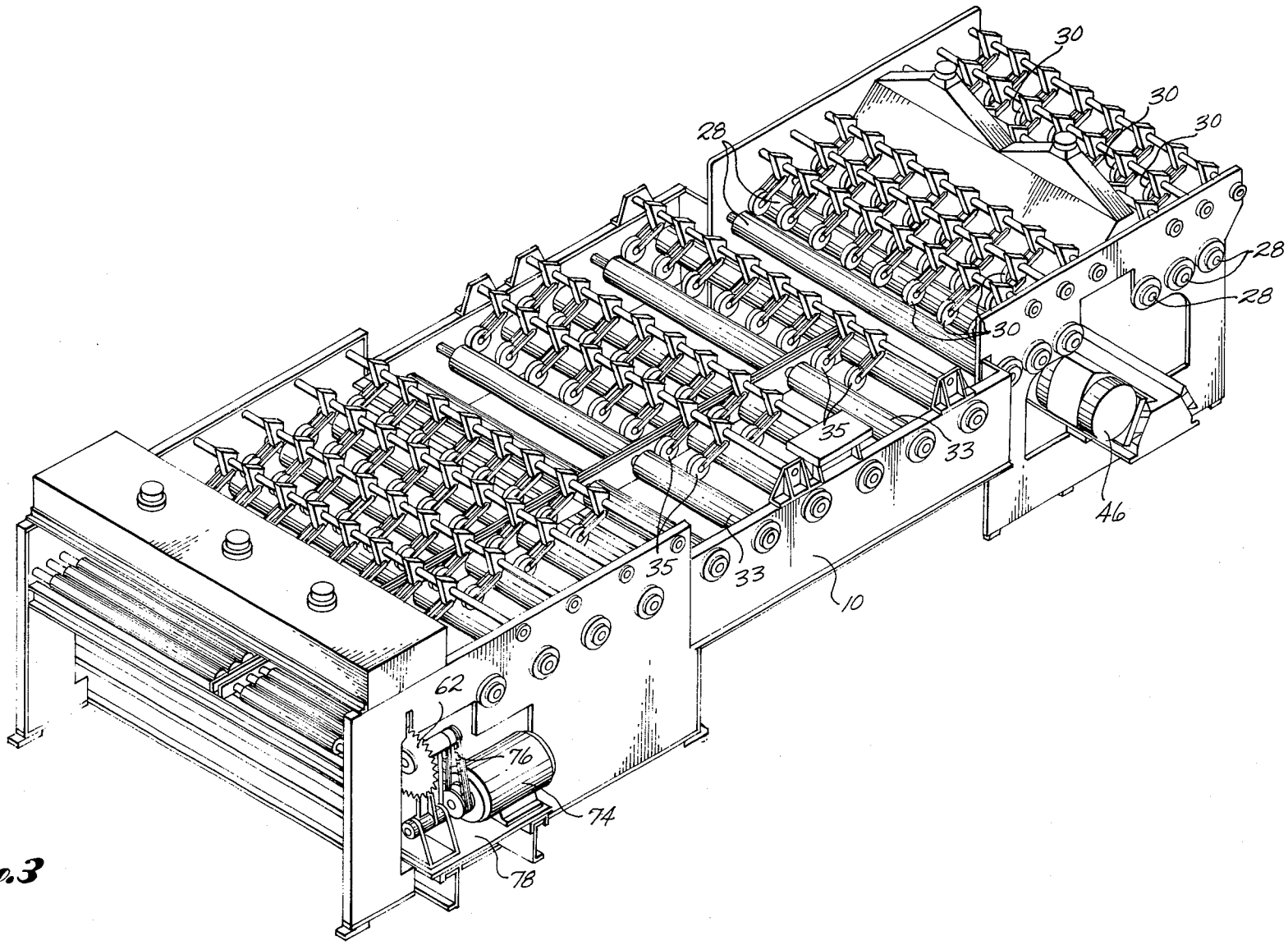
FIG. 3 is a perspective view of the machine with the in-feeding and out-feeding portions of the machine removed.
Figure 4:
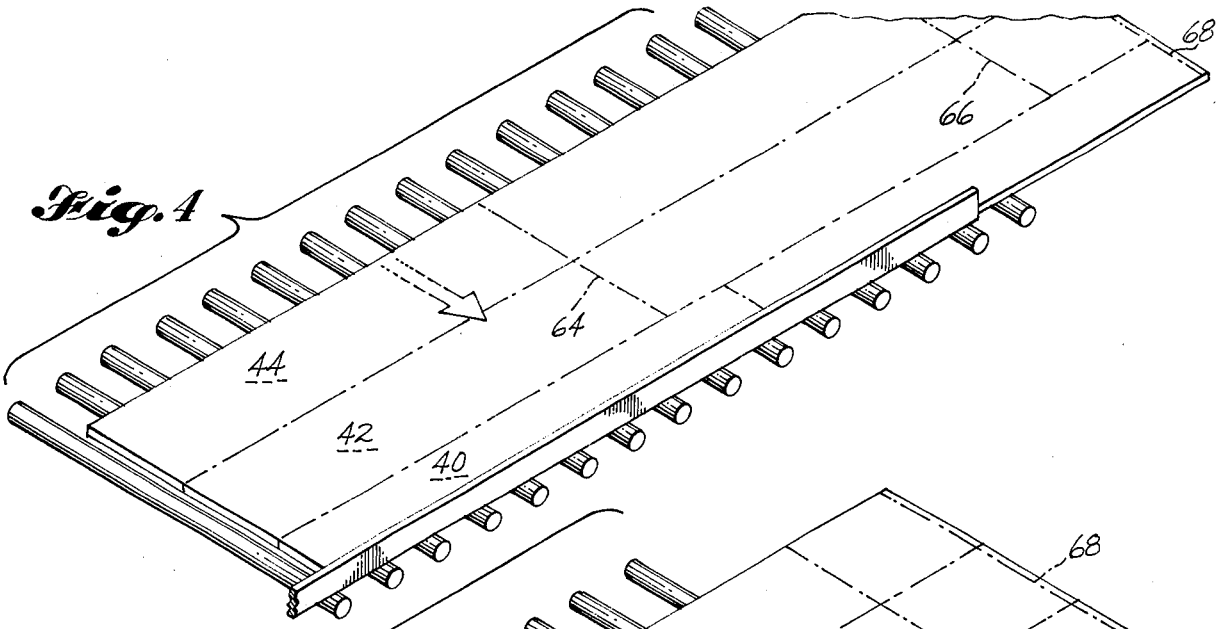
FIGS. 4–7, inclusive, are flow sheets, illustrating a panel as it is processed by the machine
Figure 5:
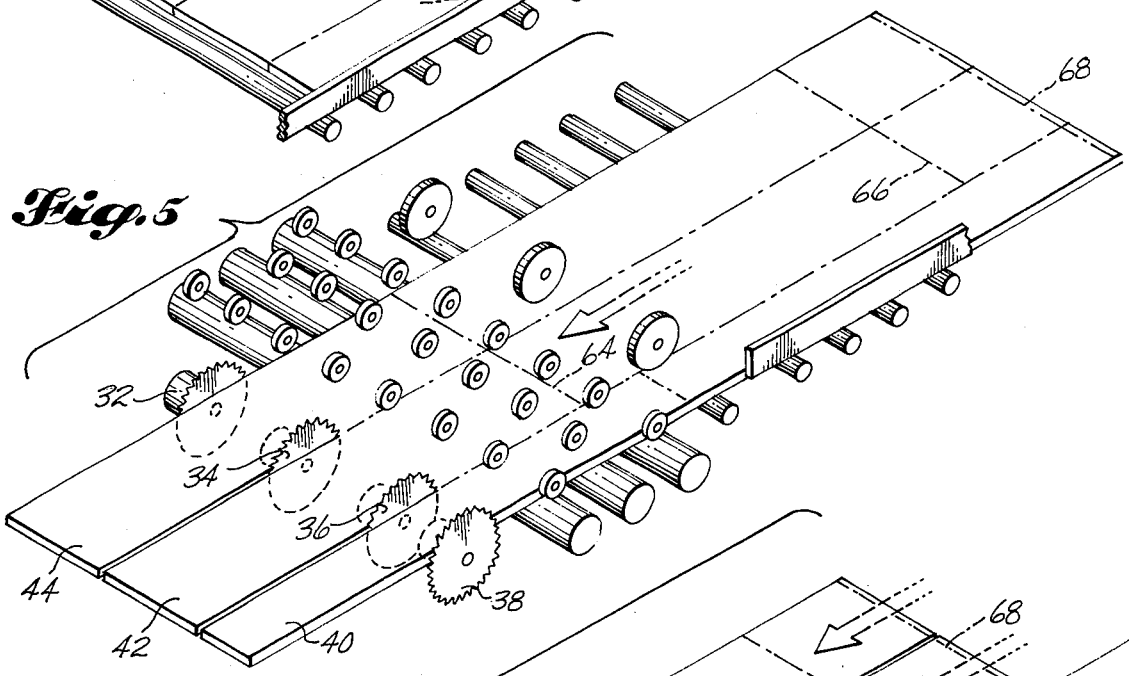

At the time that a panel is advancing toward saws 32, 34, 36, 38, the forward leading edge thereof (as viewed in FIG. 1A) abuts against a guide rail 54 and the panel is caused to travel by panel conveyor means in the direction of the arrow 24 in FIG. 1A. The panel conveyor means comprise lower driven rolls 28 and upper hold-down rolls 30 (see particularly FIG. 3) and through such means urges the panel through saws 32, 34 36, 38—all of which provide for precision sawing and edge trimming of the panel. Also, the panel conveyor means is responsive to adjustable control means as will be hereinafter more completely described.

Figure 1B:
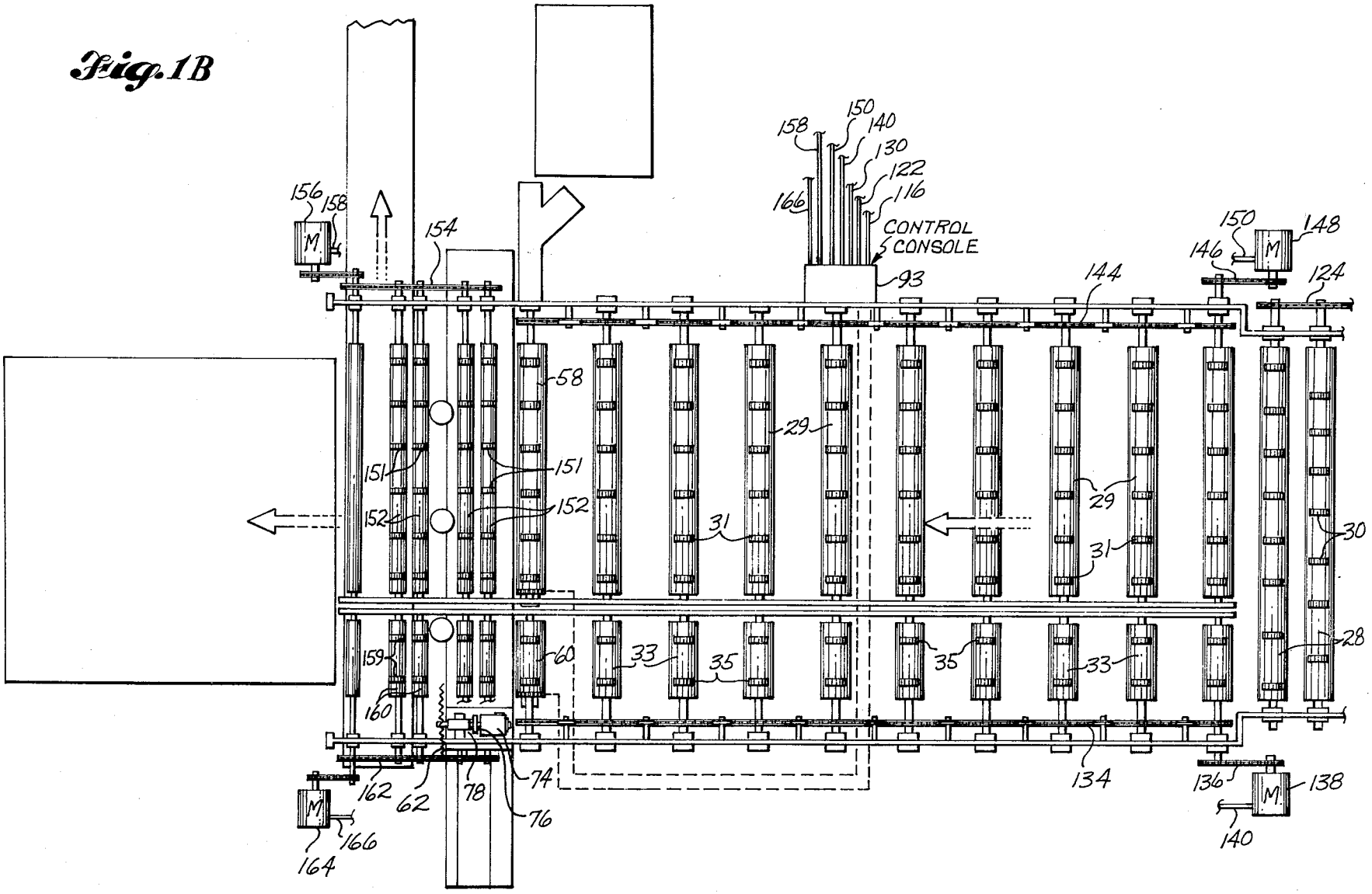
FIG. 1B is a view similar to FIG. 1A of substantially the left half portion of the machine.
Figure 8:
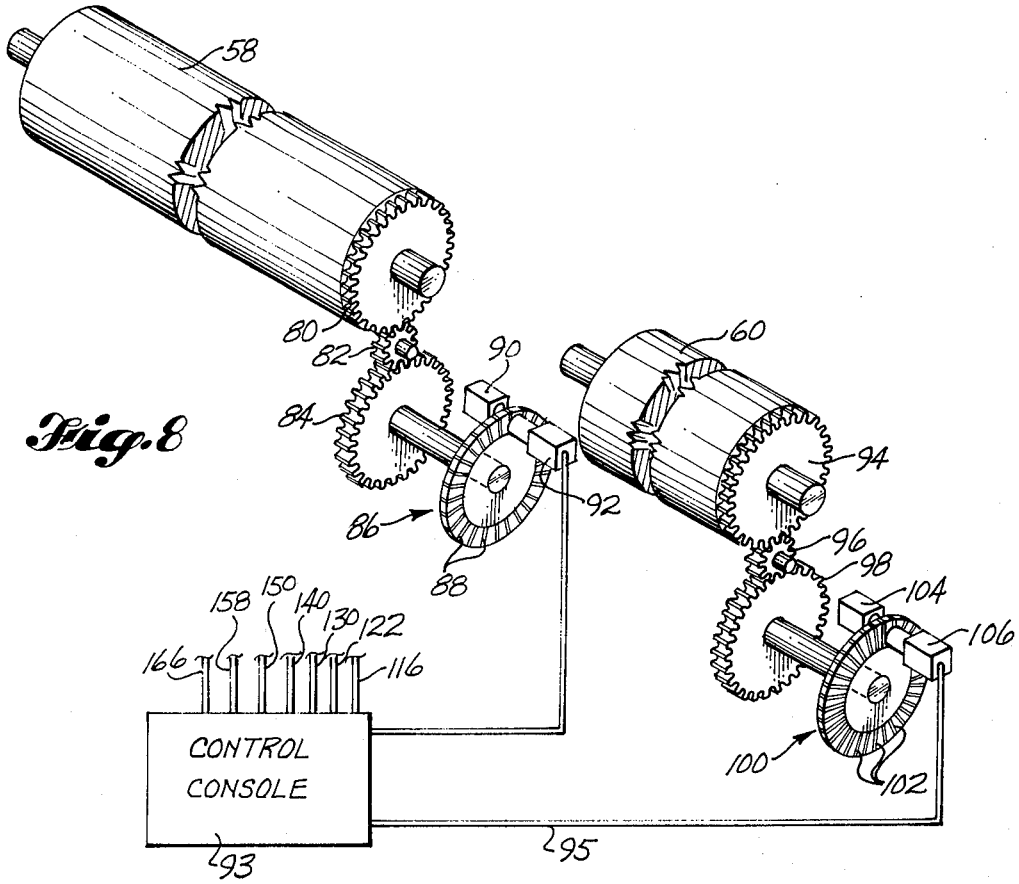
FIG. 8 is a perspective and somewhat schematic view illustrating the measuring roll for the main strip or strips, the measuring roll for the residual strip, and the light-cell actuated switch mechanism for controlling the programming of the machine.

As the pieces of main strip stock 42, 44 and residual strip 40 leave saws 32, 34, 36, 38, they are continually held in alignment by additional lower driven rolls 28 and upper holddown rolls 30 until the strips 42, 44, 40 reach two precisely milled measuring rolls—main strip measuring roll 58 and residual measuring roll 60 (FIGS. 1B and 8). Each of these measuring rolls is connected with photoelectric equipment so that each 1/32 of peripheral travel thereof and a similar lineal travel of a panel strip passing therepast will send an impulse to a computer so that programs can be preset for panels traveling through the machine. Thus, when the advancing end portion (plus an allowance for an end trim cut) of the main strips 42, 44 and residual strip 40 reach the path of travel of crosscut 62, crosswise of the direction of flow of the panels, the lower driven rolls 28 are no longer driven and are precisely held with the positions thus reached by the panel strips. Then the crosscut saw 62 is stroked and the advancing ends of the main strips 42, 44 and the advancing end of the residual strip 40 are precisely trimmed and at right angles to the side edge trim cuts previously made by saws 32 and 38.

The measuring rolls 58 and 60 are preferably subject to separate programming and if so, they may be programmed to operate both at the same time and thus advance the main strips 42 and 44 and the residual strip 40, all at the same time. They also may be programmed to advance the main strips 42, 44 and hold the residual strip 40 until after all saw cuts are made on the main strips 42, 44. The third alternative is that the main roll 58 could be held against rotation and thus prevent main strips 42, 44 from advancing and the residual measuring roll 60 caused to rotate and advance the residual strip for such treatment as desired prior to cutting on the main strips 42, 44. In the particular program illustrated in the drawings, the main strip measuring roll 58 is caused to rotate and the residual strip measuring roll is held in stop position.

Figure 6:
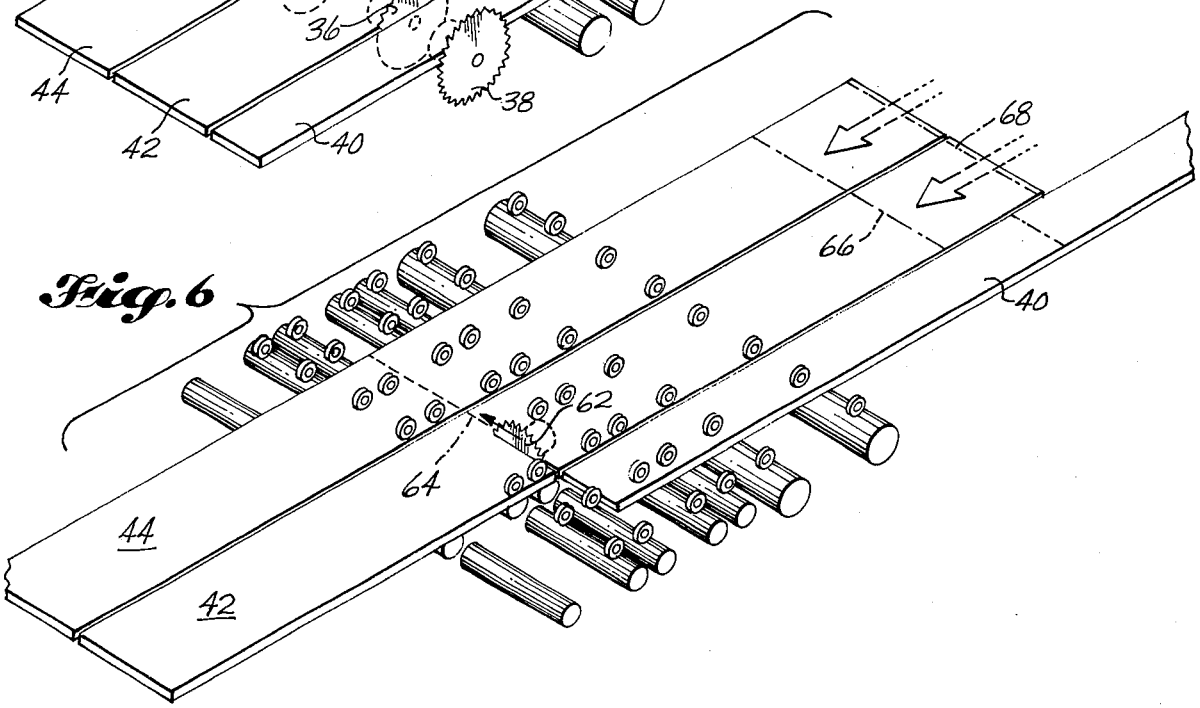

In view of the particular programming just described, the main strips 44 and 42 and the residual strip 40 are moved forward an amount programmed to provide for an end trim. All strips are held and the crosscut saw 62 is stroked through all strips to provide the desired end trimming. Thereafter, the residual strip 40 is held, the main strips 44 and 42 are moved forward a programmed amount, and thereafter the crosscut saw 62 is stroked through the main strips 42 and 44—all of which is schematically illustrated in FIG. 6. The main strips 44 and 42 are cut along a programmed line, as 64. Then the residual measuring roll 60 is continued to be held (in accordance with the program illustrated) and the main strip measuring roll 58 is caused to rotate, after crosscut saw 62 has completed its cutting stroke and has returned to its original position after its return stroke, and the main strips 44 and 42 are moved forward a programmed amount so that the crosscut saw 62 can be stroked through and returned to provide saw cut 66 through the main strips 42 and 44 and the end trim cut 68 for the main strips 42 and 44.

Also, in view of the scheduled program, the residual measuring roll 60 is now caused to turn and the residual strip 40 caused to move forward. If desired, the advancing end portion of the residual strip 40 may be again trimmed as it could be frayed by the crosscut saw 62 stroking past the trimmed end cut portion of the residual strip in providing the saw cuts on the main strips 42, 44 along cutting lines 64 and 66. Also, of course, the residual measuring roll could be programmed so the advancing end portion of the residual strip 40 is held back from the path of travel of the crosscut saw 62 so that the residual panel does not have its advancing end portion trimmed at the same time that the advancing end portions of the main strips 42, 44 are trimmed.

Regardless of when and how often the advancing end of the residual strip 40 is end trimmed, then the residual strip is now advanced, held, and cut by crosscut saw 62 and the program shown is to provide saw cuts 70 and 72 (FIG. 7) and an end trim on the trailing end portion of the residual strip 40.

Figure 2B:
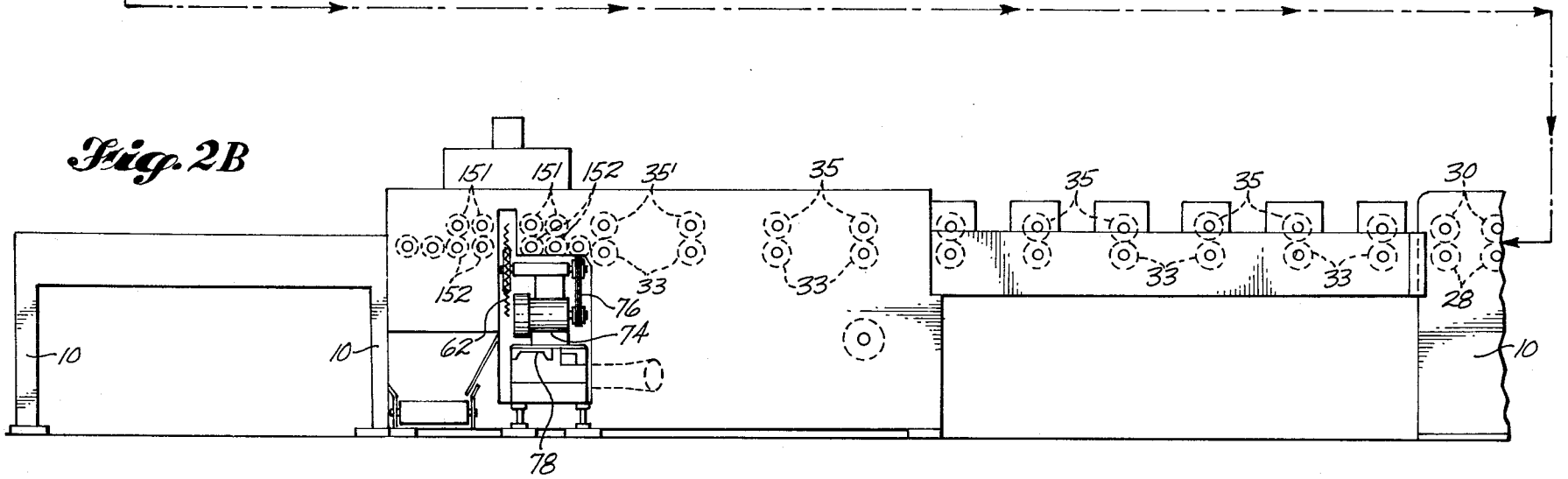
FIG. 2B is a view similar to FIG. 2A of substantially the left one-half portion of the machine.
Figure 7:
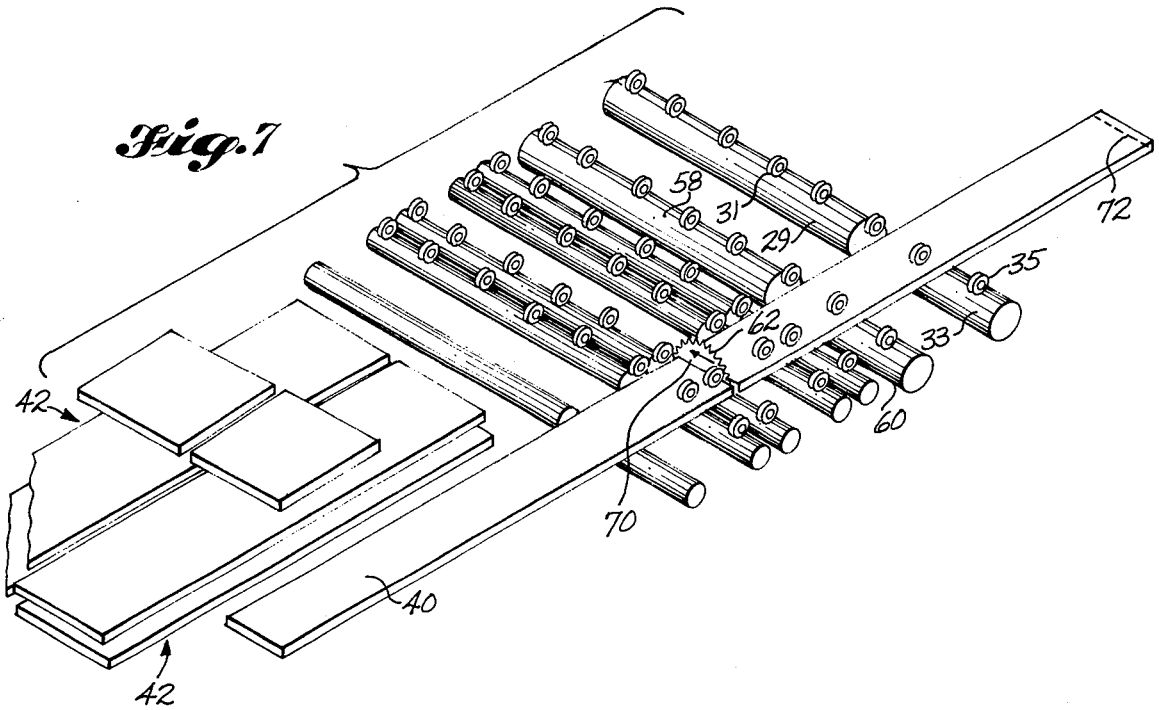

Thus, under the programming indicated, the original piece of stock is cut into a main strip or strips and the pieces thereof and a residual strip and a piece or pieces thereof and is illustrated in FIG. 7. However, any desired combination may be programmed, such as one main strip and one piece or pieces thereof and a residual strip and one piece or pieces thereof. The crosscut saw 62 (FIGS. 1B and 2B) may be continuously driven at all times during operation of the mechanism by electric motor 74 and belt 76. The motor 74, belt 76, and saw 62 are mounted as a unit on saw assembly or slide 78, which is slidably mounted on main frame 10. Suitable mechanism (not shown) is provided so that the saw assembly 78 is stroked crosswise of the path of travel of the residual and main strips 40, 42, and 44 and then returned to its original position each time the programming mechanism initiates stroking of the saw assembly.

The main strip measuring roll 58 is connected through gearing (illustrated schematically by gears 80, 82, and 84) with a wheel 86 having a plurality of slits 88 for passage of a narrow light beam therethrough. The slits 88 are spaced apart an amount equal to 1/64 inches of lineal travel of the main strips 42, 44. The source of light, illustrated by a light 90, and an electric eye mechanism 92, responsive to a light beam passing through a slit 88, are schematically shown in FIG. 8. Each time the electric eye 92 responds to a light beam passing from a light source 90 through a slit 88, an electric impulse is sent from electric eye 92 to control console 93 by way of conductors in conduit 95. A similar response system is provided between residual measuring roll 60 and control console 93 by way of gears 94, 96, 98, wheel 100, slits 102 in wheel 100, light source 104, electric eye 106, and conduit. By way of the electronics schematically illustrated and described, the control console 93 is "advised" by electrical impulses as to the exact extent of rotation of measuring rolls 58 and 60 and, in turn, the extent of travel and the exact position of strips 44, 42, and 40 in the machine. Electronic connections are also provided between the control console 93 and the drive motor 108 for all feed rolls for advancing the precisely stopping panel 16 through the machine, stroking of crosscut saw 62 at the precise time and condition of travel of the strips 40, 42, and 44 so that a program for cutting a panel can be prearranged and the machine will continue to cut the programmed pattern.

The electronic programming apparatus thus schematically illustrated and described forms no part of the present invention and is available on the market. However, the apparatus and structure controlled by such electronic equipment and all details thereof for which said electronic equipment was made constitute parts of the present invention.

The top panel 18, from the stack of panels 16 (FIGS. 1A and 2A) moves sidewise in the direction of the arrows 20 of FIG. 1A and onto conveyor rolls 22. This sidewise motion is provided by feed rolls 110 which are interconnected by belt mechanism 112, electric motor 114, and electric wiring in conduit 116. Conduit 116, and the electric wiring therein, connect with console 93 (FIGS. 1B and 8). A program is preset in console 93 so a panel 18 is moved onto conveyor rolls 22 when the successive mechanism thereafter is ready for a panel to be delivered onto such rolls 22. In this connection, the position of the measuring rolls 58 and 60, the program preset and the extent of completion thereof determine when motor 114 is energized and de-energized.

The conveyor rolls 22 are interconnected to be driven together and in the same direction by conventional cog and chain mechanism 118 (see FIGS. 1A and 2A) driven by electric motor 120 and electric conductors in conduit 122. Conduit 122, and the electric wiring therein, connect with the console 93 (FIGS. 1B and 8). Again, a program is preset in console 93 and coordinated with the positions of the measuring rolls 58 and 60 so that said conveyor rolls 22 are powered at the proper time to feed the piece of stock or panel 18 toward the saws 32, 34, 36, and 38.

Upper and lower driven feed rolls 30 and 28 are interconnected to be driven together and in the same direction by conventional cog and chain mechanism 124 and 126, respectively, (FIGS. 1A and 2A) driven by electric motor 128 and the electric conductors in conduit 130. Conduit 130, and the electrical wiring therein, connect with console 93 (FIGS. 1B and 8). Again, a program is preset and coordinated with the positions of the measuring rolls 58 and 60 so that the feed rolls 28 and 30 are driven at the present time to, through, and past saws 32, 34, 36, and 38.

The upper and lower driven feed rolls 132 (FIGS. 1B and 2B) to residual measuring roll 60 are driven in the same direction by cog and chain mechanism 134, driving belt 136, electric motor 138, and electricl conductors in conduit 140. Conduit 140 and the electric wiring therein, connect with console 93 (FIGS. 1B and 8). Again, a program is preset and coordinated with positions of the main strip measuring roll 58 so that the residual measuring roll 60 and the other devices controlled by or coordinated therewith operate at preset times therefor.

The upper and lower driven feed rolls 142 (FIG. 1B) to main measuring roll 58 are driven in the same direction by cog and chain mechanism 144, driving belt 146, electric motor 148, and electrical conductors in conduit 150. Conduit 150, and the electrical wiring therein connect with console 93 (FIGS. 1B and 8). Again, a program is preset and coordinated with the positions of the residual strip measuring roll 60 so that the main strip measuring roll 58 and the other devices controlled by or coordinated therewith operate at preset times therefor.

Pieces of main strips 42 and 44 are engaged and held by upper and lower feed rolls 152. These feed rolls 152 are driven at the same speed and in the same direction by cog and chain mechanism 154, electric motor 156, and electric conductors in conduit 158. Conduit 158, and the electric conductors therein, connect with console 93 (FIGS. 1B and 8). A main strip can be held by feed rolls 152 while it is being cross cut by saw 62, including the trimming of the trailing end portion thereof and after being cut by said saw 62, the pieces of the main strips 42 and 44 can be discharged from the machine by said feed rolls 152.

Pieces of the residual strip 40 are engaged and held by upper and lower driven feed rolls 160. These feed rolls 160 are driven at the same speed and in the same direction by the cog and chain mechanism 162, electric motor 164, and the electric conductors in conduit 166. Conduit 166, and the electric conductors therein, connect with console 93 (FIGS. 1B and 8). A residual strip can be held by rolls 160 while it is being crosscut by saw 62, including trimming of the trailing end portion thereof and after being cut by the saw 62, the cut pieces of residual strip 40 can be discharged from the machine by said feed rolls 160.

SUMMARY

The panel saw mechanism thus comprises a plurality of panel strips, rotary driven, cutting saws 32, 34, 36, 38, which are laterally adjustable or preset to edge trip two sides of a panel as 16; to cut a panel into one or more main strips of desired width, as main strips 42, 44; and to reserve a residual strip, as 40. Also, conveyor means urge a panel, as 18, through said saws and maintain said panel in alignment so the panel is precisely sawn. A crosscut saw 62 is provided which is stroked across the path of panel strips 42, 44, and 40 at right angles to the saw cuts provided by the saws 32, 34, 36, 38, and the saw is stroked while the strips have been held at predetermined positions of travel. The panel strip conveyors comprise sets of lower driven rolls 28 and upper hold-down rolls 30 which urge the panel strips 42, 44, and 40 past the cutting saws 32, 34, 36, 38. The measuring roll 58, for the main strip or strips 42, 44 is connected through gears 80, 82, 84, wheel 86, slits 88, light 90, and electric eye 92 with control mechanism in control console 93. The measuring roll 60 for the residual strip, as 40, is connected through gears 94, 96, 98, wheel 100, slits 102, light 104, and electric eye 106 with control mechanism in control console 93.

The width and number of panel strips, both main strips and the residual strip, and the side edge trimming of the panels is preset by the lateral adjustment of the ripsaws 32, 34, 36, 38 before the panels are fed through the machine. Once said lateral adjustment of the saws is provided, it will be maintained until another pattern is desired and the said ripsaws 32, 34, 36, 38 are manually laterally readjusted.

As the panels are fed through the machine, the measuring rolls 58 and 60 and the connected computer system "knows" the exact position of the main strips and the residual strips in the panel saw mechanism. Settings are made by control levers, not shown, so that the cutting pattern for end trimming both the forward and trailing end of the strips is preprogrammed. Also, a pattern is set for cutting the strips to desired length and with the main strips cut while the residual strip is held and the residual strip is cut while the next succeeding main strips are held. The electric motors for driving the feeding mechanism for feeding the panels and panel strips through the mechanism are of the type that responds to impulse energizing so that the motors turn or rotate the exact amount indicated by the computer so that the time of travel, the amount of travel, the time and duration of stopping of the main strips or the residual strips are subject to the control of the computer system, thus permitting a desired, dual programming for cutting a large panel 16 into a main strip or strips, of programmed panel length and a residual strip of programmed panel length, wherein the panel lengths of the main and residual strips may have two asymmetrical patterns.

Thus is provided adjustable control means for programming control of panels and panel strips which is connected with and operated by a predetermined amount of turning movement of the measuring roll 58 and/or 60.

There is specifically provided lower driven rolls 28 and upper hold-down rolls 30 vertically aligned with each other and holding a panel 19 and panel strips 40, 42, 44 in alignment while the panel 18 is being urged through the rotating saws 32, 34, 36, 38.

Also, panel strip conveyor means, comprising lower driven rolls and upper hold-down rolls vertically aligned with each other are provided holding the panel strips in alignment while the cutoff saw 62 is being stroked across a panel strip which may be all of the panel strips, the main panel strips, 42, 44, or may be only the residual panel strip 40.

Next, a panel edge guide or guide rail 54 may be provided at one side of the panel conveying means with conventional means (not shown) urging a panel laterally and against the edge guide rail 54 while the panel is being urged forward by the panel conveyor means.

The conveyor means urging a panel 16 through the ripsaws 32, 34, 36, 38 is subject to control means operated by a preceding panel operating measuring roll 58 and/or 60 so that succeeding panels are delayed in their travel until the crosscut saw 62 has cut to desired pattern lengths, both the main panel strips 42 and 44 and the residual panel strip 40.

Obviously, changes may be made in the forms, dimensions and arrangments of the parts of this invention without departing from the principle thereof, the above setting forth only preferred forms of embodiment of this invention.

I claim:

1. A panel saw mechanism comprising a plurality of panel strip, rotary driven, cutting saws; panel conveyor means urging a panel through said panel strip cutting saws and dividing a panel, into a plurality of strips including a main strip and a residual strip; a rotary driven, cutoff saw for sawing panel strips and cutting in a plane disposed at substantially right angles to the saw cuts of the panel strip cutting saws; a plurality of sets of panel strip conveyor means, each set disposed in the line of travel of a panel strip passing said panel strip cutting saws and each thereof urging a panel strip past said panel strip cutting saws; a plurality of measuring rolls, one thereof having a predetermined measured circumference engaging with and measuring a predetermined lineal travel of a main strip and another thereof having a predetermined measured circumference engaging with and measuring a predetermined lineal travel of a residual strip; cutoff saw stroking means stroking said cutoff saw in a path across said panel strips in one direction of its stroking and clear of said panel strips in the other direction of its stroking; a plurality of adjustable control means, one for each of the panel conveyor means and connected with and operated by a predetermined amount of turning movement of its measuring roll; and control means for said saw stroking means connected with and responsive to each of said adjustable control means.

2. The combination of claim 1, wherein said panel conveyor means comprises lower driven rolls and upper hold-down rolls vertically aligned with each other and holding a panel in alignment while it is being urged through said strip cutting saws.

3. The combination of claim 1, wherein said panel strip conveyor means comprises lower driven rolls and upper holddown rolls vertically aligned with each other and holding the panel strips in alignment while the cutoff saw is being stroked across a panel strip.

4. The combination of claim 1, wherein said control means for the operation of each of said panel strip conveyor means are provided and the operation thereof is responsive to each of said adjustable control means.

5. The combination of claim 1, wherein the operation of the control means for said saw stroking means and the operation of the control means for each of panel conveyor means are jointly responsive to said adjustable control means.

6. The combination of claim 1, wherein said panel strip cutting saws comprise a plurality of saws disposed in parallel relation and mounted for lateral adjustment toward and away from each other.

7. The combination of claim 1, wherein the panel strips are movable unequal lineal distances before the cutoff saw stroking means strokes the cutoff saw crosswise through the panel strips.

* * * * *